US012193534B2

(12) United States Patent
Moore

(10) Patent No.: US 12,193,534 B2
(45) Date of Patent: Jan. 14, 2025

(54) HARNESS FOR SECURELY WEARING A HYDRATION SCARF WHILE REDUCING HEAT TRANSFER TO THE BEVERAGE CONTAINED IN THE HYDRATION SCARF

(71) Applicant: Jodi Moore, Dayton, OH (US)

(72) Inventor: Jodi Moore, Dayton, OH (US)

( * ) Notice: Subject to any disclaimer, the term of this patent is extended or adjusted under 35 U.S.C. 154(b) by 0 days.

(21) Appl. No.: 17/867,617

(22) Filed: Jul. 18, 2022

(65) Prior Publication Data

US 2022/0395040 A1 Dec. 15, 2022

Related U.S. Application Data

(63) Continuation-in-part of application No. 16/903,330, filed on Jun. 16, 2020, now Pat. No. 11,388,941.

(51) Int. Cl.
*A41D 23/00* (2006.01)

(52) U.S. Cl.
CPC ..... *A41D 23/00* (2013.01); *A41D 2400/46* (2013.01)

(58) Field of Classification Search
CPC ..... A41D 23/00; A41D 2023/002; A41D 2023/004; A41D 2400/46; A41D 13/0007; A45F 3/16; A45F 2003/166; A45F 3/20; A47G 21/18; A47G 21/186; A47G 19/2272; A47G 19/2266; A62B 35/0006; A62B 35/0012; A62B 35/0018; A62B 35/0025; A62B 35/0031; A62B 35/0037; B63C 9/00; B63C 9/11; B63C 9/13; B63C 9/133

(Continued)

(56) References Cited

U.S. PATENT DOCUMENTS 1,650,764 A 11/1927 Marin
4,090,650 A 5/1978 Gotta
(Continued)

FOREIGN PATENT DOCUMENTS

CN 210185818 U 3/2020
JP 2019127656 A 8/2019
(Continued)

OTHER PUBLICATIONS

Website: http://wasa-bi.com/topics/1698—Downloaded Sep. 25, 2017
4mm Diameter Hydration Tube "Nano Drink Tube".
(Continued)

*Primary Examiner* — F Griffin Hall
(74) *Attorney, Agent, or Firm* — Russ Weinzimmer & Associates, PC

(57) ABSTRACT

A harness for securely wearing a hydration scarf while walking, jogging, or running, and for extending the time that a beverage in the hydration scarf remains cool. The harness has straps that secure the hydration scarf to the person wearing it, even while engaged in vigorous activity. The harness also has an insulating layer and an insulating sleeve that substantially slow the transfer of body heat into the hydration scarf. Pockets can be included for holding freezer packs in direct contact with the hydration scarf to chill the beverage. The combined effect of the insulating elements that limit heat flow from the wearer's body to the beverage, and the freezer packs that pull heat out of the beverage, is to keep the beverage at a temperature which is cooler than room temperature, and therefore more refreshing and better tasting than a beverage at room temperature.

9 Claims, 6 Drawing Sheets

(58) Field of Classification Search
USPC ..... 2/207; 224/148.1, 148.2, 148.3, 148.4, 224/148.7; 220/705, 709, 710; 222/464.1; 441/80, 88, 106, 111, 123
See application file for complete search history.

(56) References Cited

U.S. PATENT DOCUMENTS

| | | | | |
|---|---|---|---|---|
| 4,176,772 | A | 12/1979 | Danon | |
| 4,265,381 | A | 5/1981 | Muscatell | |
| 4,526,298 | A | 7/1985 | Boxer et al. | |
| 4,544,087 | A | 10/1985 | Modig | |
| 4,739,905 | A | 4/1988 | Nelson | |
| 4,805,619 | A * | 2/1989 | Swearingen | A61F 7/103 607/109 |
| 4,948,023 | A | 8/1990 | Tripp | |
| 5,060,833 | A | 10/1991 | Edison et al. | |
| 5,085,349 | A | 2/1992 | Fawcett | |
| 5,207,362 | A | 5/1993 | Janus et al. | |
| 5,431,308 | A | 7/1995 | Tchen | |
| 5,571,260 | A | 11/1996 | Krug | |
| 5,622,293 | A | 4/1997 | LeFevre | |
| 5,645,404 | A | 7/1997 | Zelenak | |
| 5,722,573 | A | 3/1998 | Carnel | |
| 5,806,726 | A | 9/1998 | Ho | |
| 5,940,880 | A | 8/1999 | Phillips | |
| 5,984,145 | A | 11/1999 | McAllister | |
| 6,220,490 | B1 | 4/2001 | O'Hara | |
| 6,283,344 | B1 | 9/2001 | Bradley | |
| 6,581,811 | B1 | 6/2003 | Schillaci | |
| 6,598,770 | B2 | 7/2003 | Bolts | |
| 6,749,090 | B2 | 6/2004 | Bailey | |
| 6,820,780 | B2 | 11/2004 | Forsman et al. | |
| 7,497,186 | B2 | 3/2009 | Dorton et al. | |
| 7,552,734 | B2 | 6/2009 | Adams | |
| 7,766,193 | B2 | 8/2010 | Stollmann et al. | |
| 8,082,753 | B1 | 12/2011 | Alvarez, Jr. et al. | |
| 8,286,592 | B2 | 10/2012 | Moinester | |
| 8,453,893 | B2 | 6/2013 | Shitaye | |
| 8,544,688 | B2 | 10/2013 | Ballentine | |
| 8,708,194 | B2 | 4/2014 | Pascatore | |
| 9,314,119 | B2 | 4/2016 | Parker et al. | |
| 9,591,911 | B2 | 3/2017 | Hopmeier | |
| 10,327,535 | B2 * | 6/2019 | Steele | A45F 3/00 |
| 10,499,697 | B1 * | 12/2019 | Posta | A41D 27/201 |
| 10,893,711 | B1 * | 1/2021 | Davis | A61F 7/02 |
| 2002/0092858 | A1 | 7/2002 | Bowman | |
| 2004/0128747 | A1 | 7/2004 | Bumbarger et al. | |
| 2007/0028359 | A1 | 2/2007 | Robinson et al. | |
| 2007/0090135 | A1 | 4/2007 | Benham | |
| 2007/0221692 | A1 | 9/2007 | Witten | |
| 2008/0185408 | A1 | 8/2008 | James | |
| 2010/0084290 | A1 | 4/2010 | Anson et al. | |
| 2010/0116848 | A1 * | 5/2010 | Powers | A45F 3/20 219/544 |
| 2011/0240703 | A1 | 10/2011 | Tobin et al. | |
| 2013/0146623 | A1 | 9/2013 | Murray | |
| 2013/0247271 | A1 | 9/2013 | Bowen et al. | |
| 2013/0284762 | A1 | 10/2013 | Voss | |
| 2017/0055495 | A1 | 3/2017 | Atkins | |
| 2017/0129687 | A1 | 5/2017 | Atkins | |
| 2019/0380477 | A1 * | 12/2019 | Loftin | A45F 3/005 |
| 2022/0338650 | A1 * | 10/2022 | Toliver | A47G 9/1045 |

FOREIGN PATENT DOCUMENTS

| | | |
|---|---|---|
| WO | 198300608 | 3/1983 |
| WO | 198702873 | 3/1987 |
| WO | 2006081081 A2 | 8/2006 |
| WO | 2009007969 | 1/2009 |

OTHER PUBLICATIONS

Website: https://www.revzilla.com/motorcycle/kriega-hands-free-hydration-tube—Downloaded Sep. 25, 2017 Kriega Hands-Free Hydration Tube.
Website: https://www.thegreenhead.com/2008/02/wine-rack-drink-dispensing-secret-bra-flask.php—Downloaded Sep. 25, 2017 Wine Rack Drink Dispensing Secret Bra Flask.
Website: http://baxbo.com/gifts/flasktie-flaskscarf/—Downloaded Sep. 25, 2017 Flask Scarf/Flask Tie.
Website: https://www.roguepak.com/—Downloaded Sep. 25, 2017 RoguePak Cartridge Hydration System.
YouTube: https://www.youtube.com/watch?v=Q3r5wNNUkAY—Downloaded Sep. 22, 2017 Wetsleeve—Wearable Hands-Free Hydration.
YouTube: https://www.youtube.com/watch?v=AL0XiMUNVs8—Downloaded Sep. 26, 2017 The SmartTube—a hydration pack alternative.
Website: https://www.amazon.com/VooDoo-Tactical-Hydration-Carrier-Removable/dp/B0042G7DOE/ref=sr_1_13?dchild=1&hvadid=7017902233&hvbmt=bb&hvdev=c&hvqmt=b&keywords=tactical%2Bhydration%2Bpouch&qid=1596400352&sr=8-13&tag=mh0b-20&th=1—Downloaded Jul. 27, 2020 VooDoo Tactical Men's Hydration Carrier with Removable Harness.
Website: https://ultraspire.com/products/astral-3-0/—Downloaded Jul. 27, 2020 Astral 3.0 Women's Specific Hydration Pack.
Website: https://www.thegreenhead.com/2008/02/wine-rack-drink-dispensing-secret-braflask.php—Downloaded Jul. 27, 2020 Wine Rack Drink Dispensing Secret Bra Flask.
Website: https://www.amphipod.com/products/hydration/purerun-vests/purerun-minimalist-24—Downloaded Jul. 28, 2020 Amphipod PureRun Vest.

* cited by examiner

HARNESS FOR SECURELY WEARING A HYDRATION SCARF WHILE REDUCING HEAT TRANSFER TO THE BEVERAGE CONTAINED IN THE HYDRATION SCARF

CROSS-REFERENCE TO RELATED APPLICATIONS

The present application is a Continuation-in-Part of application Ser. No. 16/903,330 filed Jun. 16, 2020, titled "HYDRATION SCARF WITH SECURING TABS FOR CONVENIENTLY CONTAINING, CARRYING, AND CONSUMING A BEVERAGE", which is hereby incorporated by reference in its entirety.

FIELD OF THE INVENTION

This invention relates generally to beverage containers, and particularly to harnesses for securely wearing a beverage container.

BACKGROUND OF THE INVENTION

There are many types of personal hydration devices that allow a user to drink hands-free, while engaging in activities such as jogging, hiking, bicycling, or other forms of physical exercise. Historically, examples of these can be worn around the waist, or on the user's back. Other examples can be worn as a vest, or can be carried over the shoulder, or can be worn on the user's head.

A hydration scarf has been taught by Moore in U.S. Pat. No. 10,709,184 B2. The hydration scarf can contain a beverage, and can be worn around the neck so as to make consumption of the beverage very convenient. The hydration scarf includes a U-shaped container portion including: a first hanging portion, a curved portion, a second hanging portion.

When the hydration scarf is worn around the neck of a person that is standing still, gravity maintains the hydration scarf in place. However, when a person wearing the hydration scarf begins an activity, such as jogging or playing tennis, the inertia of the beverage in the hydration scarf causes the hydration scarf to move relative to the person wearing it. If the person wearing the hydration scarf changes speed or direction abruptly, the hydration scarf could fall off and onto the ground.

Further, while the hydration scarf is worn around the neck of a person, the curved portion of the hydration scarf typically makes contact with the bare skin of the back of the neck of the person. In addition, both the first and second hanging portions make contact with the front of the person, which could be bare skin, or thin fabric. Bare skin and thin fabric both allow body heat to radiate and/or conduct into the beverage contained by the hydration scarf, thereby undesirably warming the beverage. Since a person generates a substantial amount of body heat during exercise, wearing a hydration scarf during exercise typically results in the beverage becoming unacceptably warm by the time the person needs to drink the beverage.

SUMMARY OF THE INVENTION

The invention is a harness for securely wearing a hydration scarf while walking, jogging, or running, and for extending the time that the beverage in the hydration scarf remains cool.

The harness of the invention includes a plurality of straps that secure the hydration scarf to the person wearing it, even while engaged in vigorous activity, such as running or playing tennis. Thus, the inertia of the beverage in the hydration scarf cannot cause the hydration scarf to fall off the person wearing it. If the person wearing the hydration scarf changes speed or direction abruptly, the hydration scarf will move with the person.

Further, the harness of the invention includes both an insulating layer for each hanging portion, and an insulating sleeve for the curved portion that typically makes contact with the bare skin of the back of the neck of the person. The insulating layers and the insulating sleeve substantially impede the transfer of body heat via radiation and/or conduction into the beverage contained by the hydration scarf, thereby extending the time that the beverage remains cool.

Additionally, pockets can be included for holding freezer packs in direct contact with each of the hanging portions of the hydration scarf, thereby chilling the beverage contained therein.

The combined effect of the insulating elements that limit heat flow from the wearer's body into the beverage (thereby preventing the temperature of the beverage from going above ambient temperature), and the freezer packs that pull heat out of the beverage (thereby causing the temperature of the beverage to fall below ambient temperature), is to keep the beverage at a temperature which is more refreshing and tastes better to most people than room temperature water.

For example, water that is at 60° F., such as cool tap water, is considered by many to be the most optimal for hydration. Also, drinking cold water after an exercise session that is intense enough to produce a sweat helps a person's core temperature to cool down, thereby restoring equilibrium.

Alternatively, many professionals recommend drinking water at room temperature, especially when the body is overheated. So, according to the invention, one can forgo the use of the freezer packs with the Harness of the invention if one expects to exercise until being overheated.

A general aspect of the invention is a harness for securely wearing a hydration scarf while reducing heat transfer to the beverage in the hydration scarf, the hydration scarf including a U-shaped beverage tube having a right descending portion, a left descending portion, and a curved portion connecting the right descending portion with the left descending portion. The harness incudes: a U-shaped insulating layer including: a right insulating layer portion, a left insulating layer portion, and a curved insulating layer portion connecting the right insulating layer portion with the left insulating layer portion; an adjustable chest strap having a right end connected to the right insulating layer portion and a left end connected to the left insulating layer portion; and an adjustable waist strap having a right end slidably connected to the right insulating layer portion and a left end slidably connected to the left insulating layer portion.

In some embodiments, the adjustable chest strap includes a buckle.

In some embodiments, the adjustable waist strap includes a buckle.

In some embodiments, the harness further includes: an insulating sleeve surrounding the curved insulating layer portion, and configured to surround the curved portion of the U-shaped beverage tube.

In some embodiments, the harness further includes: a right pocket attached to the right insulating layer portion, the right pocket configured to hold an end of the right descending portion of the U-shaped beverage tube, and configured to hold a right freezer pack in thermal contact with the right descending portion of the U-shaped beverage tube; and a left pocket attached to the left insulating layer portion, the left pocket configured to hold an end of the left descending portion of the U-shaped beverage tube, and configured to hold a left freezer pack in thermal contact with the left descending portion of the U-shaped beverage tube.

In some embodiments, the harness further includes: a right freezer pack configured to be held in the right pocket; and a left freezer pack configured to be held in the left pocket.

In some embodiments, the harness further includes: at least one right hook and loop material fastener configured to secure the right descending portion of the U-shaped beverage tube to the right insulating layer portion; and at least one left hook and loop material fastener configured to secure the left descending portion of the U-shaped beverage tube to the left insulating layer portion.

In some embodiments, the harness further includes: a layer of dry fabric backing the U-shaped insulating layer, the layer of dry fabric configured to wick away moisture from a person wearing the harness.

In some embodiments, the right descending portion of the U-shaped beverage tube includes a right tab, the left descending portion of the U-shaped beverage tube includes a left tab, and the harness further includes: a right hook and loop material fastener configured to secure the right tab of the U-shaped beverage tube to the right insulating layer portion; and a left hook and loop material fastener configured to secure the left tab of the U-shaped beverage tube to the left insulating layer portion.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1:
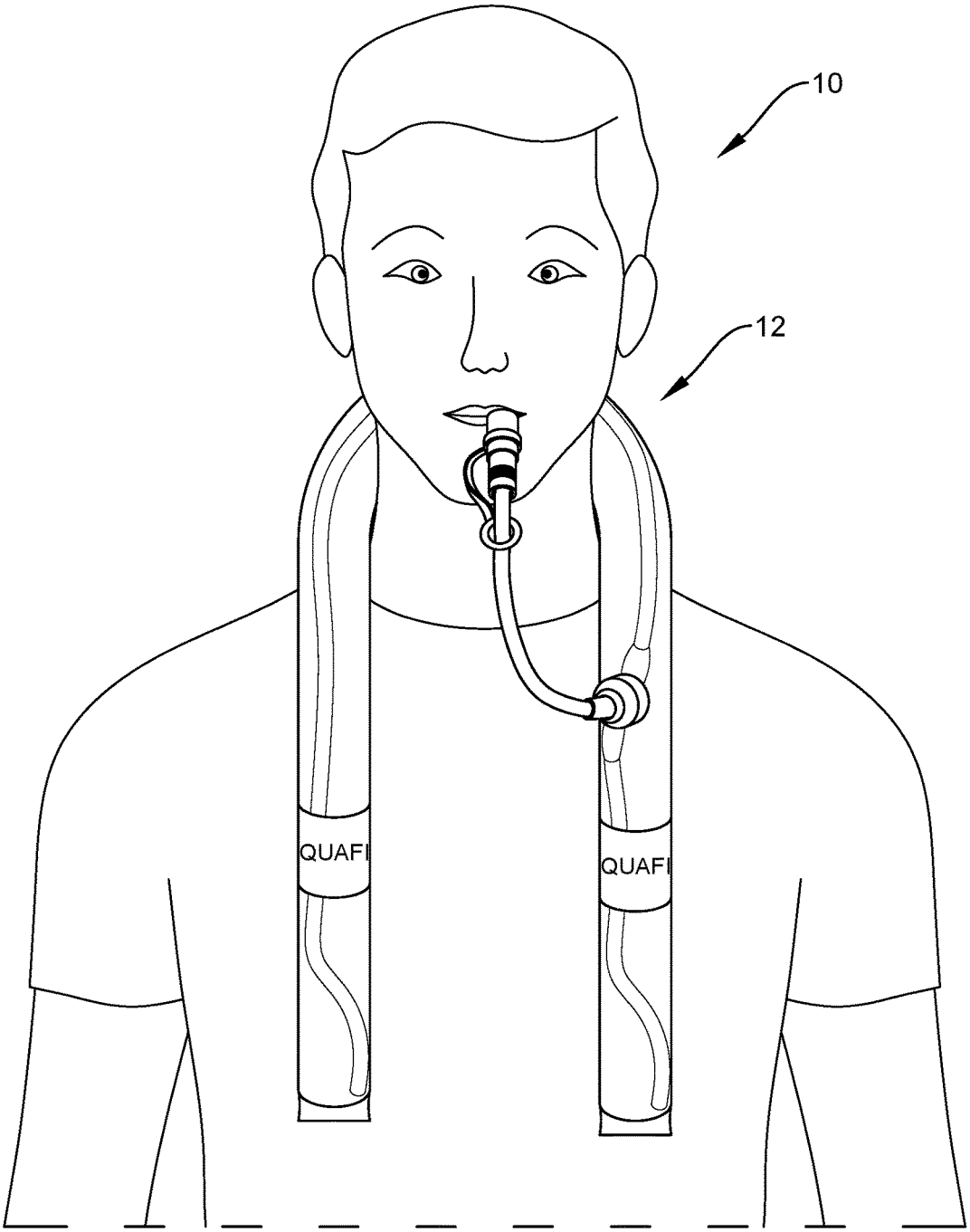
Prior Art FIG. 1
FIG. 1 is a front view of a person wearing a hydration scarf as taught in Moore U.S. Pat. No. 10,709,184 B2.

FIG. 1 is a front view of a person 10 wearing a hydration scarf 12 as taught in Moore U.S. Pat. No. 10,709,184 B2.

Figure 2:
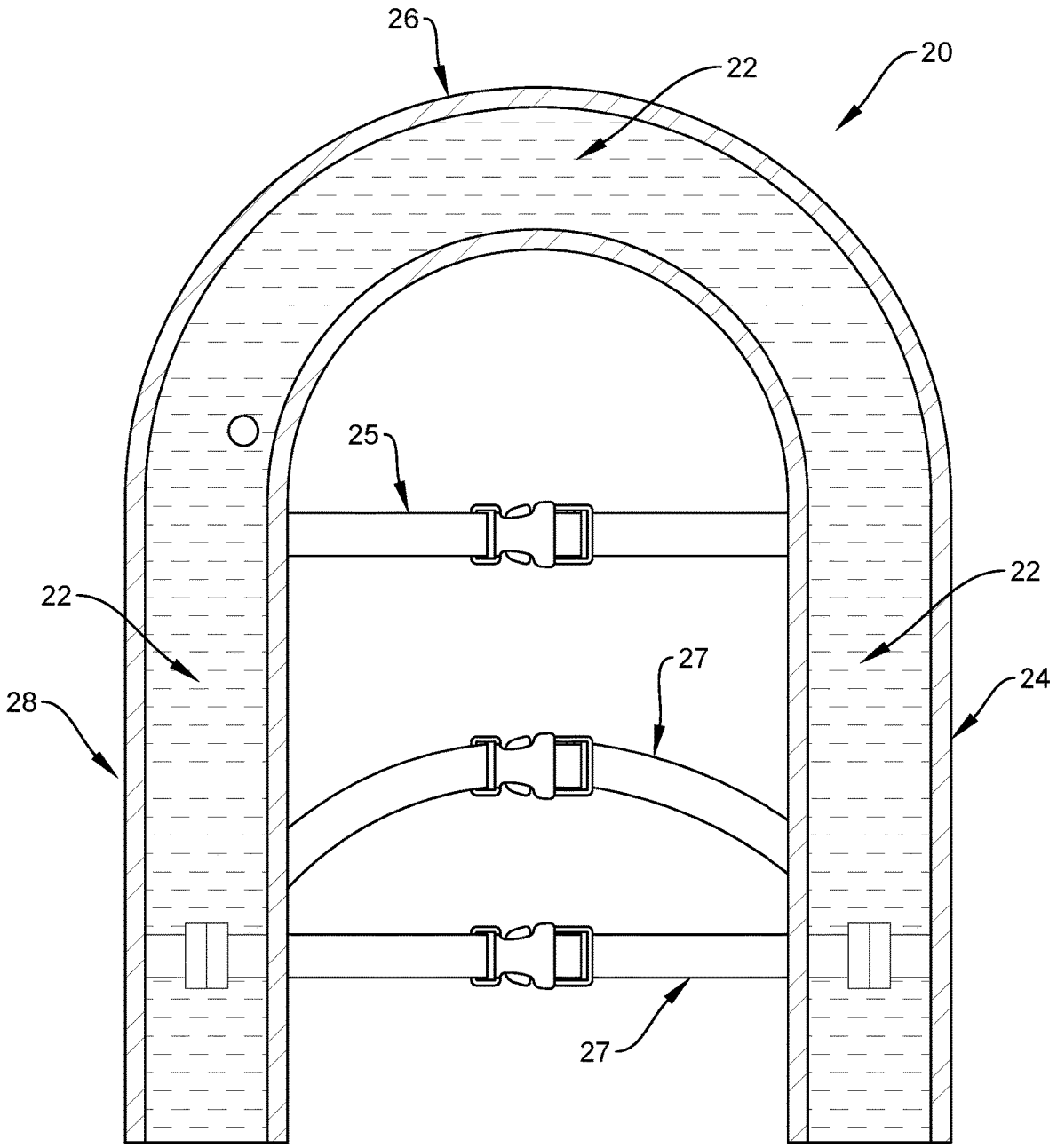
FIG. 2 is a front view of an embodiment of the harness, showing the U-shaped insulating layer having a right insulating layer portion, continuous with a curved insulating layer portion, continuous with a left insulating layer portion, also showing an adjustable chest strap and an adjustable waist strap.

FIG. 2 is a front view of an embodiment of the harness 20, showing the U-shaped insulating layer 22 having a right insulating layer portion 24, continuous with a curved insulating layer portion 26, continuous with a left insulating layer portion 28, also showing an adjustable chest strap 25 and an adjustable waist strap 27.

Figure 3:
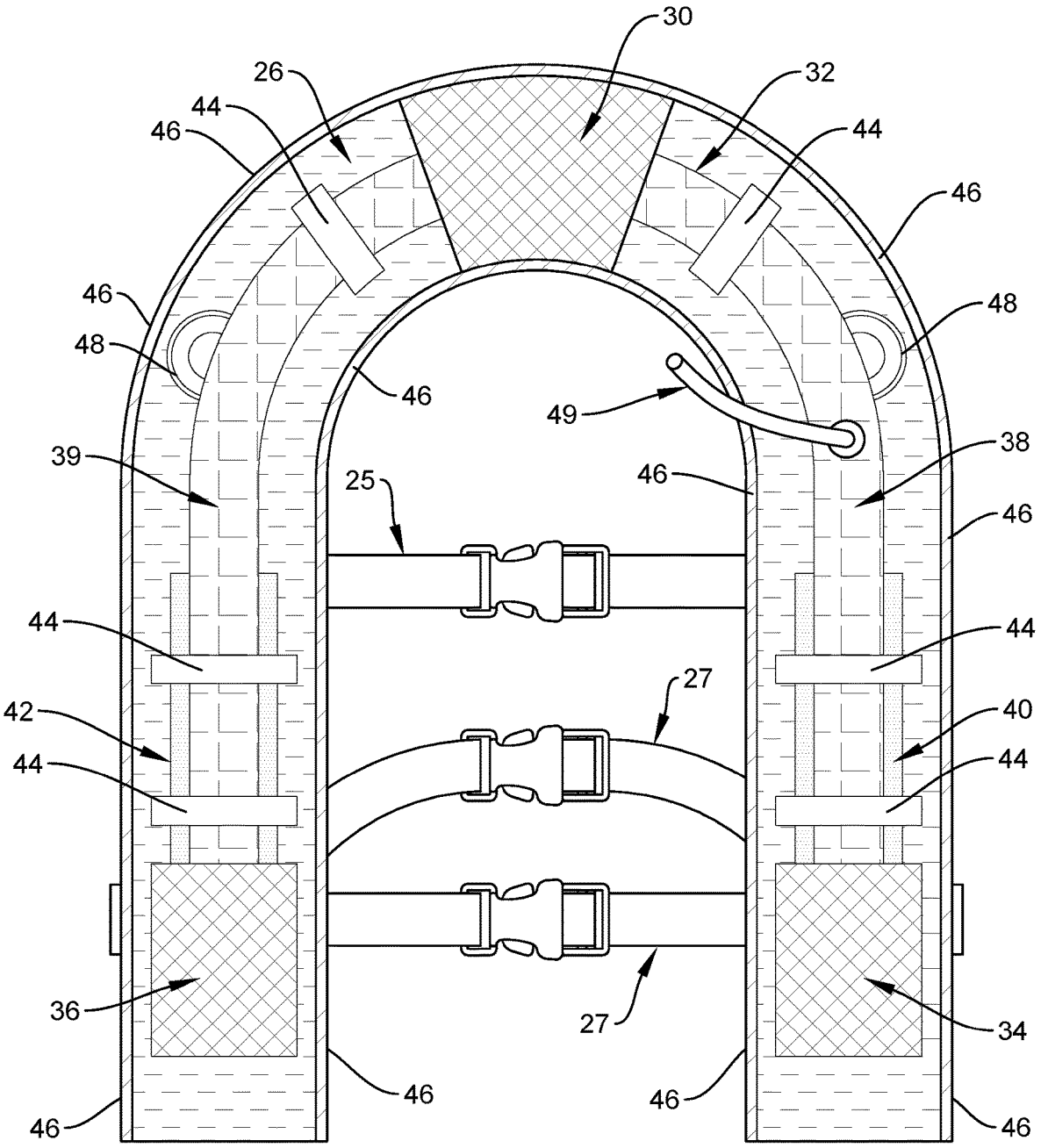
FIG. 3 is a front view of the embodiment of the harness of FIG. 2, further showing an insulating sleeve surrounding both the curved insulating layer portion and the curved portion of the U-shaped beverage tube, also showing right and left pockets for respectively holding the right and left descending portions of the U-shaped beverage tube, and for respectively holding right and left freezer packs, also showing hook and loop material fasteners for securing the descending portions of the U-shaped beverage tube to the respective insulating layer portions, also showing a layer of dry fabric backing attached to the U-shaped insulating layer, also showing right and left tabs of the U-shaped beverage tube.

FIG. 3 is a front view of the embodiment of the harness 20 of FIG. 2, further showing an insulating sleeve 30 surrounding both the curved insulating layer portion 26 and the curved portion 32 of the U-shaped beverage tube 12, also showing right and left pockets 34, 36 for respectively holding the ends of the right and left descending portions 38, 39 of the U-shaped beverage tube 12, and for respectively holding right and left freezer packs 40, 42, also showing hook and loop material fasteners 44 for securing the descending portions 38, 39 of the U-shaped beverage tube 12 to the respective insulating layer portions 24, 28, also showing a layer of dry fabric backing 46 attached all along the U-shaped insulating layer, also showing right and left tabs 48 of the U-shaped beverage tube 12.

Figure 4:
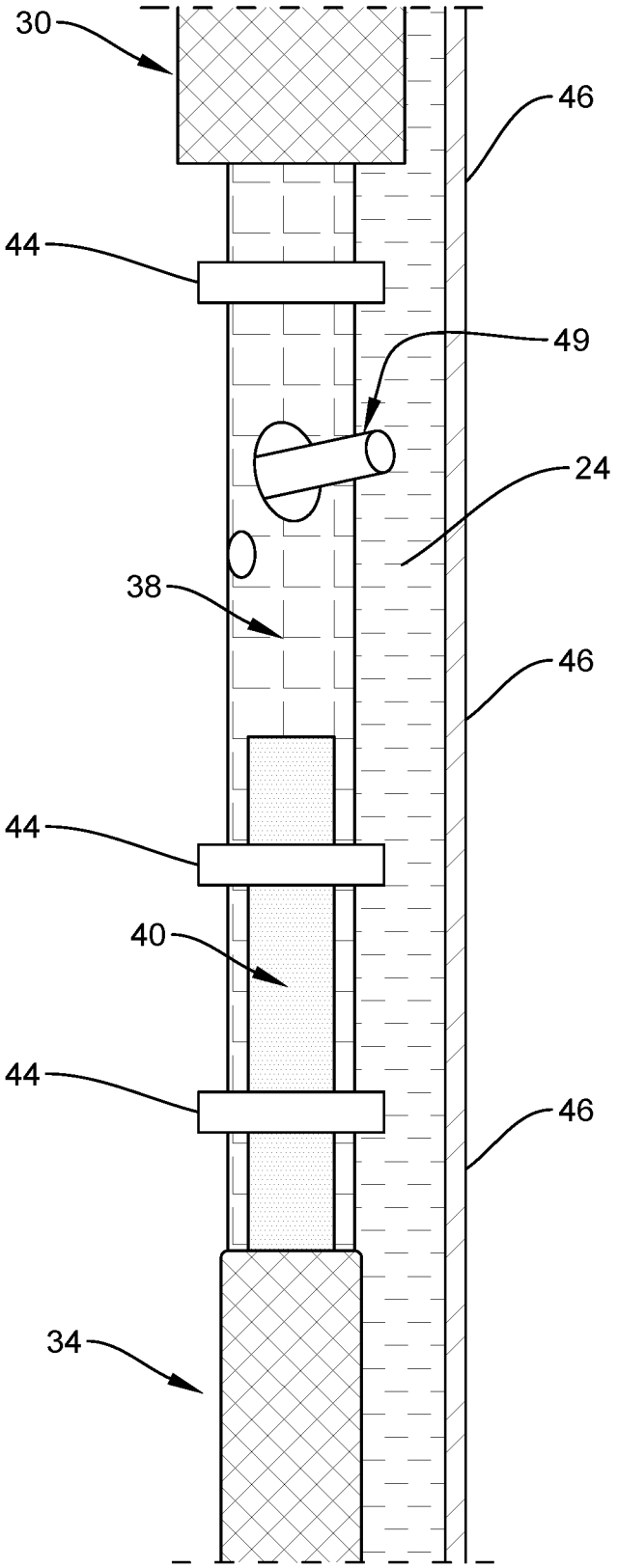
FIG. 4 is a side view of the embodiment of the harness of FIG. 3, showing the insulating sleeve, and one of the descending portions of the U-shaped beverage tube running along the respective insulating layer portion, also showing hook and loop material fasteners for securing the descending portion to the respective insulating layer portion, also showing a pocket for holding the descending portion of the U-shaped beverage tube and a freezer pack, also showing the layer of dry fabric backing attached along the respective insulating layer portion, also showing the drinking straw of the U-shaped beverage tube.

FIG. 4 is a side view of the embodiment of the harness of FIG. 3, showing the insulating sleeve 30, and one of the descending portions 38 of the U-shaped beverage tube 12 running along the respective insulating layer portion 24, also showing hook and loop material fasteners 44 for securing the descending portion 38 to the respective insulating layer portion 24, also showing a pocket 34 for holding the descending portion 38 of the U-shaped beverage tube 12 and a freezer pack 40, also showing the layer of dry fabric backing 46 attached along the respective insulating layer portion 24, also showing the drinking straw 49 of the U-shaped beverage tube 12.

Figure 5:
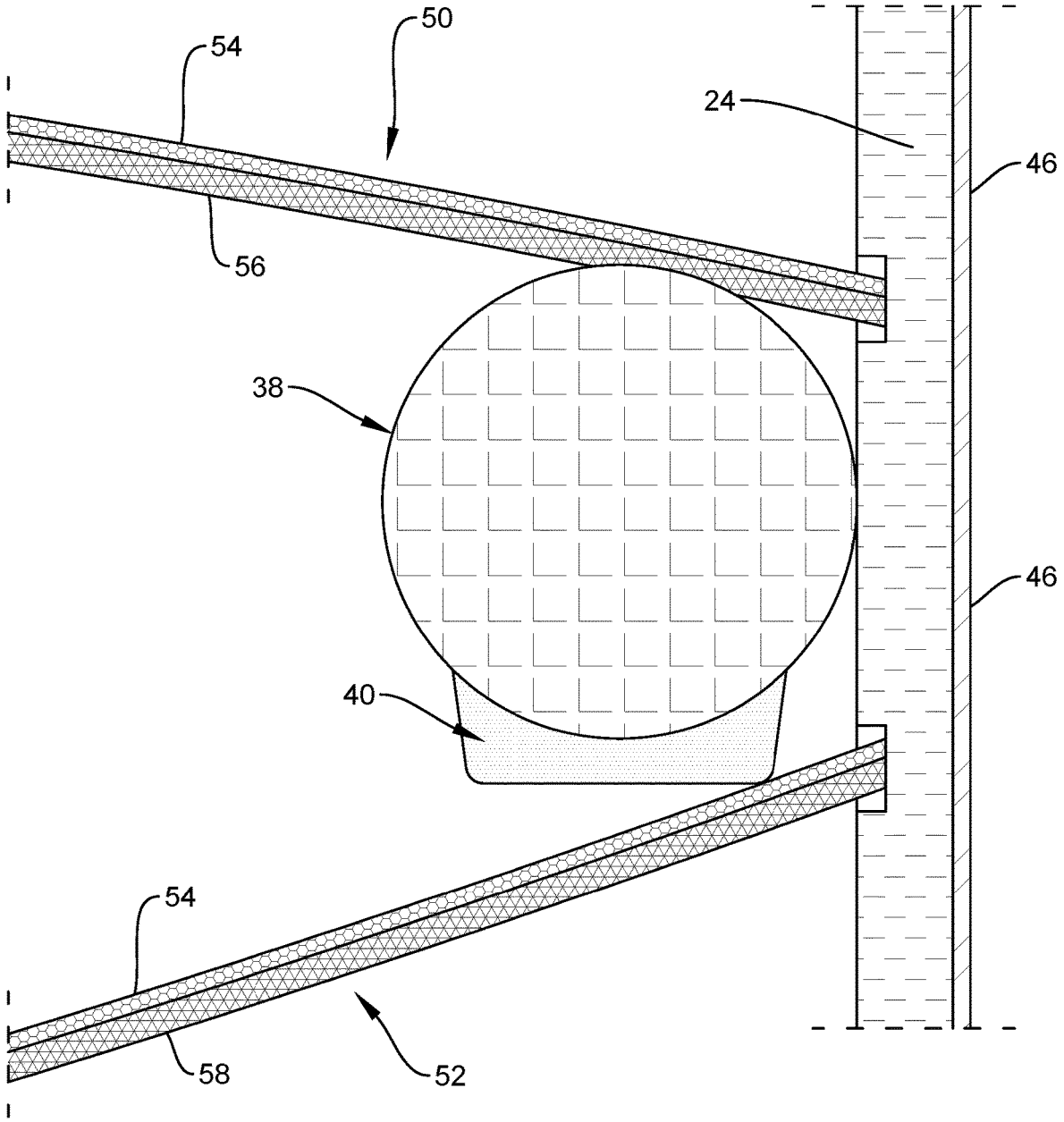
FIG. 5 is a cross-sectional bottom view looking up an insulating layer portion of the harness and up a descending portion of the U-shaped beverage tube, also showing two parts of the hook and loop material fasteners for securing the descending portion to the insulating layer portion, also showing a freezer pack contacting and conforming to the descending portion of the U-shaped beverage tube, also showing the layer of dry fabric backing attached along the insulating layer portion.

FIG. 5 is a cross-sectional bottom view looking up an insulating layer portion 24 of the harness 20 and up a descending portion 38 of the U-shaped beverage tube 12, also showing two parts 50, 52 of the hook and loop material fasteners 44 for securing the descending portion 38 to the insulating layer portion 24, also showing a freezer pack 40 contacting and conforming to the descending portion 38 of the U-shaped beverage tube 12, also showing the layer of dry fabric backing 46 attached along the insulating layer portion 24. Each of the two parts 50, 52 of the hook and loop material fasteners 44 includes a structural layer 54, made from woven nylon, for example, and a hook material layer 56 or loop material layer 58, such that the hook material layer 56 can engage with the loop material layer 58, or vice versa.

Figure 6:
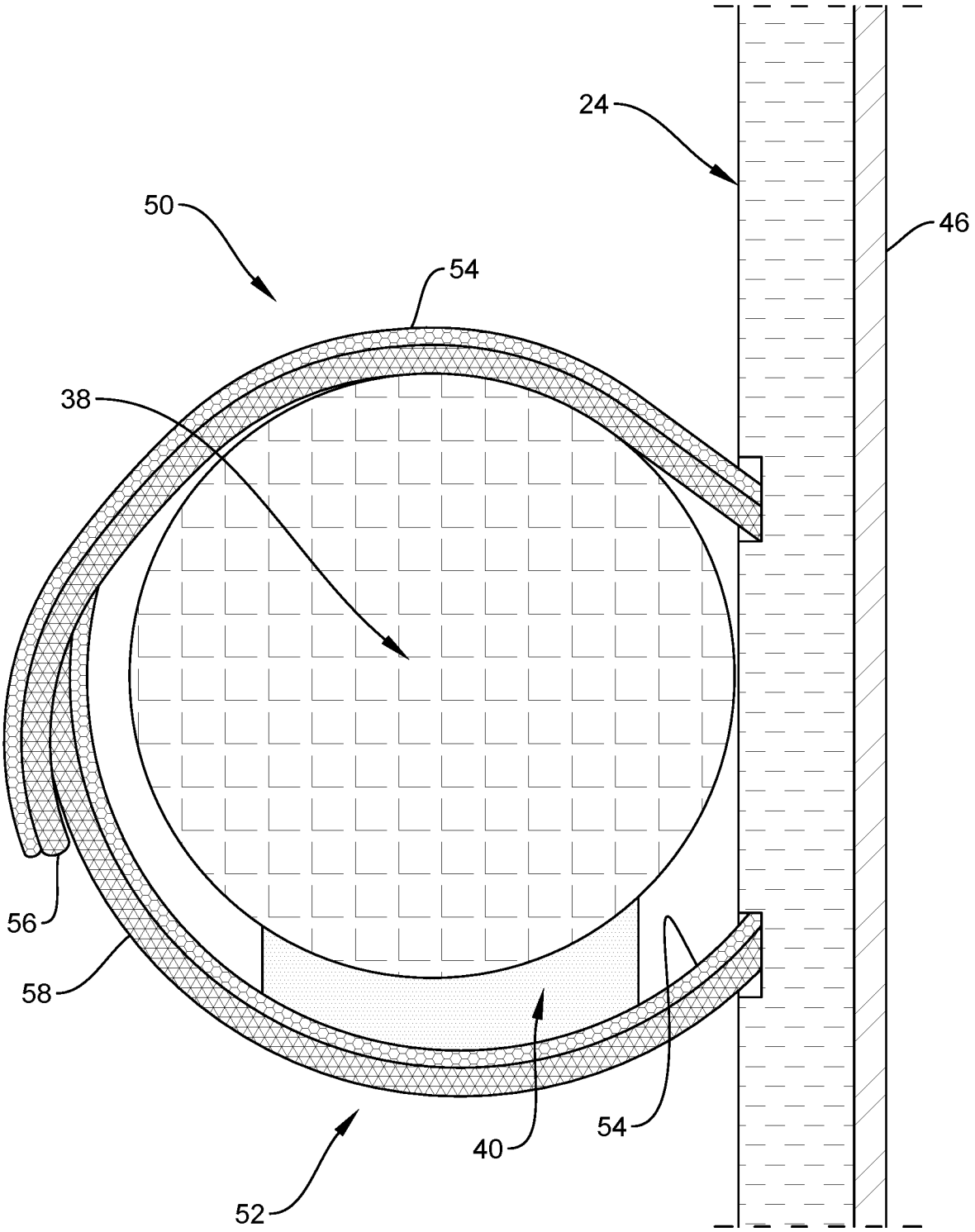
FIG. 6 is a cross-sectional bottom view of the embodiment of FIG. 5, showing the two parts of the hook and loop material fasteners mutually engaged so as to secure the descending portion to the insulating layer portion, and to secure the freezer pack in thermally contacting relationship with the descending portion of the U-shaped beverage tube.

FIG. 6 is a cross-sectional bottom view of the embodiment of FIG. 5, showing the two parts 50, 52 of the hook 56 and loop 58 material fasteners mutually engaged so as to secure the descending portion 38 to the insulating layer portion 24, and to secure the freezer pack 40 in thermally contacting relationship with the descending portion 38 of the U-shaped beverage tube 12.

Other modifications and implementations will occur to those skilled in the art without departing from the spirit and the scope of the invention as claimed. Accordingly, the above description is not intended to limit the invention, except as indicated in the following claims.

What is claimed is:

1. A harness for securely wearing a hydration scarf while reducing heat transfer to the beverage in the hydration scarf, the hydration scarf including a U-shaped beverage tube having a right descending portion, a left descending portion, and a curved portion connecting the right descending portion with the left descending portion, the harness comprising:

a U-shaped insulating layer including:

a right insulating layer portion, a left insulating layer portion, and a curved insulating layer portion connecting the right insulating layer portion with the left insulating layer portion;

an adjustable chest strap having a right end connected to the right insulating layer portion and a left end connected to the left insulating layer portion; and an adjustable waist strap having a right end slidably connected to the right insulating layer portion and a left end slidably connected to the left insulating layer portion.

2. The harness of claim 1, wherein the adjustable chest strap includes a buckle.

3. The harness of claim 1, wherein the adjustable waist strap includes a buckle.

4. The harness of claim 1, further comprising:

an insulating sleeve surrounding the curved insulating layer portion, and configured to surround the curved portion of the U-shaped beverage tube.

5. The harness of claim 1, further comprising:

a right pocket attached to the right insulating layer portion, the right pocket configured to hold an end of the right descending portion of the U-shaped beverage tube, and configured to hold a right freezer pack in thermal contact with the right descending portion of the U-shaped beverage tube; and a left pocket attached to the left insulating layer portion, the left pocket configured to hold an end of the left descending portion of the U-shaped beverage tube, and configured to hold a left freezer pack in thermal contact with the left descending portion of the U-shaped beverage tube.

6. The harness of claim 5, further comprising:

a right freezer pack configured to be held in the right pocket; and a left freezer pack configured to be held in the left pocket.

7. The harness of claim 1, further comprising:

at least one right hook and loop material fastener configured to secure the right descending portion of the U-shaped beverage tube to the right insulating layer portion; and at least one left hook and loop material fastener configured to secure the left descending portion of the U-shaped beverage tube to the left insulating layer portion.

8. The harness of claim 1, further comprising:

a layer of dry fabric backing the U-shaped insulating layer, the layer of dry fabric configured to wick away moisture from a person wearing the harness.

9. The harness of claim 1, wherein the right descending portion of the U-shaped beverage tube includes a right tab, the left descending portion of the U-shaped beverage tube includes a left tab, the harness of claim 1 further comprising:

a right hook and loop material fastener configured to secure the right tab of the U-shaped beverage tube to the right insulating layer portion; and a left hook and loop material fastener configured to secure the left tab of the U-shaped beverage tube to the left insulating layer portion.

* * * * *